US008176938B2

(12) United States Patent
Queau et al.

(10) Patent No.: US 8,176,938 B2
(45) Date of Patent: May 15, 2012

(54) HYDROCARBON TRANSFER SYSTEM WITH HORIZONTAL DISPLACEMENT

(75) Inventors: Jean-Pierre Queau, Nice (FR); Walter Willy Maurel, Beaulieu sur Mer (FR); Philippe Albert Christian Menardo, Nice (FR)

(73) Assignee: Single Buoy Moorings Inc., Marly (CH)

( * ) Notice: Subject to any disclaimer, the term of this patent is extended or adjusted under 35 U.S.C. 154(b) by 660 days.

(21) Appl. No.: 12/295,440

(22) PCT Filed: Mar. 29, 2007

(86) PCT No.: PCT/EP2007/053016

§ 371 (c)(1),
(2), (4) Date: Sep. 30, 2008

(87) PCT Pub. No.: WO2007/113201

PCT Pub. Date: Oct. 11, 2007

(65) Prior Publication Data

US 2010/0243075 A1 Sep. 30, 2010

(30) Foreign Application Priority Data

Mar. 30, 2006 (EP) ..... 06112025

(51) Int. Cl.
*F17D 1/00* (2006.01)

(52) U.S. Cl. ..... 137/615; 137/342; 141/387

(58) Field of Classification Search ..... 137/615, 137/342; 141/387; 441/5
See application file for complete search history.

(56) References Cited

U.S. PATENT DOCUMENTS

| | | | | |
|---|---|---|---|---|
| 4,276,917 | A * | 7/1981 | Fujita | 137/615 |
| 4,393,906 | A * | 7/1983 | Gill | 141/387 |
| 4,658,874 | A * | 4/1987 | von Meyerinck et al. | 137/615 |
| 4,987,925 | A * | 1/1991 | Vroonland | 137/615 |
| 7,147,022 | B2 * | 12/2006 | Le Devehat | 141/387 |
| 2003/0136132 | A1 | 7/2003 | Harley et al. | |

FOREIGN PATENT DOCUMENTS

| | | |
|---|---|---|
| EP | 1389580 | 2/2004 |
| GB | 2367049 | 3/2002 |
| WO | 0181163 | 11/2001 |
| WO | 2005105565 | 11/2005 |

OTHER PUBLICATIONS

International search report in corresponding PCT/EP2007/053016, mailed Jun. 8, 2007.

* cited by examiner

*Primary Examiner* — Kevin Lee
(74) *Attorney, Agent, or Firm* — Young & Thompson

(57) ABSTRACT

A hydrocarbon transfer system comprising a first structure with a length direction and a transverse direction having a frame carrying a fluid transfer duct with at its end a fluid connecting member for connecting to a second structure which is moored alongside the first structure and wherein the fluid transfer duct is placed on a movable frame part which is displaceable in the transverse direction.

18 Claims, 3 Drawing Sheets

HYDROCARBON TRANSFER SYSTEM WITH HORIZONTAL DISPLACEMENT

BACKGROUND OF THE INVENTION

The invention relates to a hydrocarbon transfer system comprising a first structure having a length direction, a width direction and a deck level, a support structure extending upwardly from deck level of the first structure and supporting a track extending in the transverse direction, a movable frame part being connected to the track, a substantially transverse member and a vertical member being attached to the movable frame part, a vertical member extending downwardly from a first end of the transverse member from a movable joint such as to be pivotable around a first axis extending in the length direction and a second axis extending in the transverse direction Such a hydrocarbon transfer system is known from EP-A-1 389 580. In the known system, a vertical tower is attached to a submerged production/storage vessel. A transverse manipulator arm is attached to the tower and has telescoping arm parts that can move transversely with respect to the vessel. A vertical suspension member extends downwardly from the free end of the manipulator arm and can rotate around an axis extending in the manipulator arm direction and around a second axis extending in a length direction of the vessel. The lower end of the suspension member carries a structural connector for attaching to receiving vessel moored alongside the storage vessel. A flexible hose extends from the tower to the lower end of the suspension member for attaching to fluid transfer ducts on the receiving vessel.

The known transfer system has as a disadvantage that the storage vessel is submerged below water level and that the deck is not accessible. Furthermore, the flexible fluid transfer duct extends across a relatively large distance and occupies the space between the far side of the storage vessel and the receiving vessel, hence hampering deck access even in case the deck level would be raised above water level. The curved flexible transfer duct is furthermore subject to uncontrolled swinging motions caused by wind and by wave movements which may result in undesired forces on the points where the flexible duct is connected to the tower and to the structural connector at the end of the vertical suspension member. The first structure may be a quay, tower, barge, vessel or the like.

Another hydrocarbon transfer system of the above-mentioned type is known from WO 2005/105565 A1 which shows a first vessel for containing hydrocarbons and hydrocarbon transfer means which are connected to a tank on the first vessel. The hydrocarbon transfer means comprise a connecting member for connecting to a second vessel which is moored at a relative large distance of for example 25 m or more alongside the first vessel. The hydrocarbon transfer means bridging the large gap between the two structures comprise a frame for carrying the fluid transfer duct with a connecting member at one of its ends. Such a large distance mooring arrangement between two structures is known from unpublished patent application EP051042182 "Soft quay mooring" in the name of applicant.

The known hydrocarbon transfer system has as a disadvantage that when the connecting member is connected to the second vessel, stress is created in the fluid transfer duct and/or the frame because of movement of the moored second vessel relative to the first vessel. As the transfer ducts need to bridge a large gap of more than 25 m between the two structures which are moving relative to each other, large forces and moments are introduced in the transfer system bridging the gap. The end of the transfer ducts will need to follow the movements of the second structure which creates a motion envelope for the connector in which the system must be able to function correctly and safely. The combination of large distance, large dimensions of the transfer system and motion envelope creates inertia related fatigue problems within the transfer system. On top of the motion envelope there will be a relative large draft variation (up to 5 m) between the two structures during the offloading off LNG from one structure into the other structure as in the case of two floating structures one will rise from a loaded draft level to an unloaded draft level while the draft level will increase. In addition to this, there are relative movements between the structures even when a vessel is moored alongside a static structure, like a quay. One of the movements of a moored second structure is a sway motion or roll motion in the direction from and towards the first structure alongside which the second structure is moored. The know transfer system compensates that movement by a vertical transfer duct part which is connected to the frame pivotable around an axis extending in the length direction. Because of the pivoting displacements of the vertical transfer duct part, also an additional up and down displacement of the connecting member relative to the first structure is created. This up and down movement of the connection member is in the height direction and creates stress in the fluid transfer duct and/or the frame. Stress in the fluid transfer duct and/or the frame can create leakage of the transferred materials. Because the hydrocarbon transfer system is used for transferring highly inflammable hydrocarbons, such as LNG, leakage must at all times be avoided. Therefore the stress in the fluid transfer duct and/or the frame of the hydrocarbon system must be brought to a minimum.

A further disadvantage of the known hydrocarbon transfer system is that because of the pivoting movement of the vertical transfer duct around the axis extending in the length direction, large displacements of the moored second structure from and towards the first structure can not be compensated.

Another disadvantage of the known hydrocarbon transfer system is that it cannot function correctly over such a large distance if there is a variation in the position of the connection points or flanges on the second structure, as the motion envelope of the end of the transfer duct will be completely different. Another disadvantage related to the large distance between the two structures and the large variations in draft (up to 5 m) between the two structures during offloading of LNG is that the known loading arms can not provide the same motion envelope of the connector at the end of the fluid duct which is needed in all circumstances.

SUMMARY OF THE INVENTION

The present invention has as an object to provide a hydrocarbon transfer system in which the above mentioned problems are solved. It is in particular an object of the present invention to provide a hydrocarbon transfer system which leaves a relatively large available deck area and in which the fluid transfer lines take up a relatively small volume of space. It is also an object of the present invention to provide a hydrocarbon transfer system in which the motions imparted to the transfer system can be taken up by a relatively rigid construction. The transfer system should compensate for large draft variations during the offloading of LNG from one structure to the other and be able to bridge varying distances between the moored structures while allowing wave-induced motions which result in relative low stress on the mooring arms. It is again an object to provide a transfer system that bridges a large distance between two structures and which can be adjusted to the different positions of the connection point or connection flanges on the second structure.

Hereto a hydrocarbon transfer system according to the invention is characterised in that deck level is situated above water level, the transverse member comprising a rigid fluid transfer duct, vertical member comprises a fluid transfer duct, wherein a second end of the transverse duct is attached to an inboard fluid transfer duct on the first structure situated closer to deck level than the transverse duct, via a length-adjustment fluid transfer member which is can be horizontally displaced upon movement of the second end of the transverse duct relative to the inboard fluid transfer duct. By using rigid piping for the transverse fluid transfer duct, a compact construction is achieved which is not subject to large swinging motions induced by wind and waves. The horizontal displacement of the transverse duct of the invention is compensated for by the length-adjustment fluid transfer duct that is situated for its larger part inboard of the vessel in the region of the support structure, such that the deck space occupied is relatively small. A flexible cryogenic hose may be used as a length-adjustment member.

In another embodiment, the length-adjustment fluid transfer member connects the fluid transfer duct to storage/processing or further transfer elements via a pivoting hard pipe construction and an in-line swivel coupling. The length-adjustment member comprises a first pipe having a first end attached to the transverse duct via a first swivel, a second pipe attached with a first and to the second end of the first pipe via a second swivel and attached with a second end to the inboard duct via a third swivel, the first, second and third swivels each being rotatable around an axis that extends in the length direction. In this construction, the movements of the length-adjustment member are well-defined and are confined to a relatively small space. The rigid pipes are particularly suitable to provide a safe thermally insulated transfer duct for cryogenic hydrocarbons, such as for instance LNG.

Hereby the fluid transfer duct can be correctly positioned for each second structure individually. In the desired position the frame will be locked, so that further movement will not be possible. Its is also possible that the moored second structure can move from and toward the first structure and that this movement is compensated by the moveable frame part without creating additional displacements of the connecting member relative to the first structure.

In an embodiment of the invention, the movable frame part is placed on a track extending in the transverse direction and projecting beyond a perimeter of the first structure, for example by 15 m or more. By using a track the displacement of the movable frame part is realised with a simple and durable construction. Because the track projects beyond the perimeter of the first structure, this embodiment is preferably used to adjust the transfer duct position so that it can be connected to each connection point on the moored second structure in the transverse direction. When no second structure is moored, alongside the first structure the transfer duct can be moved inward from at the first structure into a storage position. The track has preferably a total length of between the 20 and 40 meters.

In a further embodiment of the invention, the first structure comprises a frame part that is displaceable in the height direction as well. An advantage of this embodiment is that the position of the transfer ducts can be adjusted in accordance with the draft variations during offloading or loading LNG from one structure to the other, so to ensure at all times the same motion envelope for the connector end of the transfer duct. Draft variations of the moored second structure in the height direction can be compensated for without creating any additional displacements of the connecting member relative to the first structure. A further advantage is that this allows to first position the connecting member of the hydrocarbon transfer system exactly above the cooperating connecting member of the second vessel and to then lower the connection member of the transfer system in a straight line on the connection member of second structure.

In an embodiment of the invention the movable frame part is placed on a track carried by a support structure extending upwardly from deck level of the first structure, a transverse arm or duct being connected to the movable frame part and a vertical transfer duct part extending downwardly from the transverse arm or duct in a movable joint such as to be pivotable around a first axis extending in the length direction and a second axis extending in the transverse directions. The pivotable vertical transfer duct part is used to compensate small movements of the moored second structure in the transverse and length direction. For adjusting the transfer duct exactly above the connector of each second structure in the transverse direction, the movable frame part will be displaced.

The movable frame can be provided with multiple fluid transfer arms.

In again another embodiment of the invention the transverse arm or duct is pivotably connected to the movable frame part and a counterweight is connected at or near an end of the transverse arm or duct. Hereby movement of the moored second structure in the height direction of the first structure can be compensated. The transverse arm or duct is pivotable around an axis extending in the length direction. The transverse arm or duct may also be pivotable around an axis extending in the height (vertical) direction. This can be realised by making the frame rotatable around a vertical axis. The hydrocarbon transfer system may comprise an actuator on the movable frame part for pivoting of the transverse arm or duct. The actuator can be used to actively displace the connection member.

Furthermore, the vertical duct transfer part may comprise a rigid arm which is connected to the horizontal duct part via a swivel allowing rotation around an axis extending in the length direction and an axis extending in the transverse direction.

BRIEF DESCRIPTION OF THE DRAWINGS

The invention will be discussed in detail with reference to the accompanying drawings, wherein.

DETAILED DESCRIPTION OF THE PREFERRED EMBODIMENTS

Figure 1:
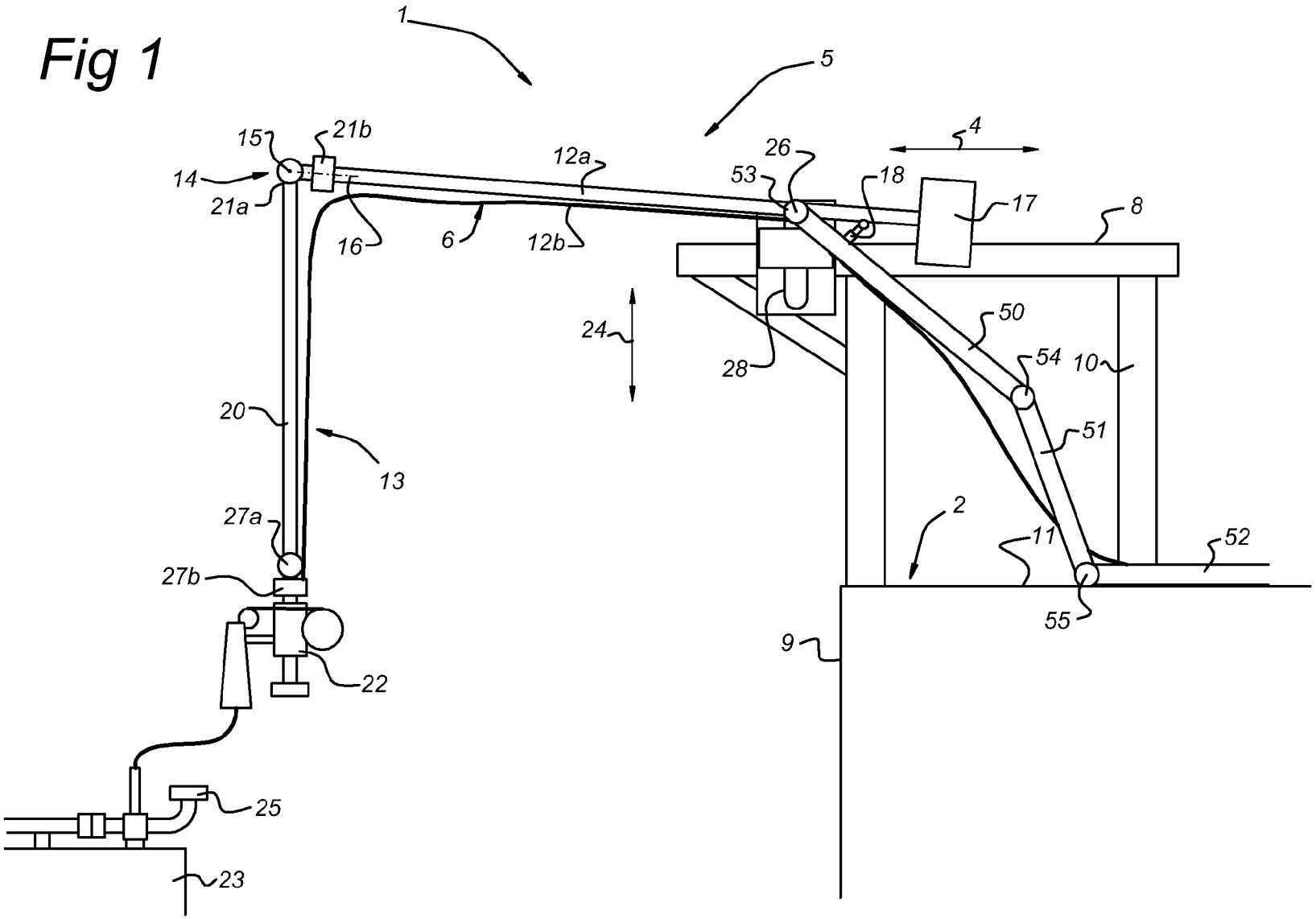
FIG. 1 schematically shows a side view of an embodiment of the hydrocarbon transfer system according the invention, FIG. 2 schematically shows a plan view of the hydrocarbon transfer system of FIG. 1, and FIG. 3 schematically shows a side view of the hydrocarbon transfer system according the invention with a vertical flexible hose part.

FIG. 1 shows an embodiment of the hydrocarbon transfer system 1 according the invention. The hydrocarbon transfer system 1 comprises a first structure 2 with a length direction extending perpendicular to the plane of the drawing arrow (3 of FIG. 2), transverse direction 4 and height direction 24. The first structure 2 can be a sea-bed supported gravity based structure (GBS), quay, tower or a floating structure like a spread moored or weathervaning FSRU, a gas liquefaction plant or a floating power plant. The first structure 2 has a frame 5 which carries a fluid transfer duct 20,12*a*. At its free end the fluid transfer duct has a connecting member 22 for connecting to a cooperating connecting member 25 of a second structure 23. The second structure 23 is moored alongside the first structure 2 and can be a shuttle tanker for transporting LNG. The frame 5 has a movable frame part 7 which is displaceable in the transverse direction 4. The frame part 7 moves over a track 8 which is supported by a support structure 10 which extends upwardly from deck level 11 of the first structure 2. The track 8 extends (more than 10 m) in the transverse direction and beyond the perimeter 9 of the first structure 2. A transverse fluid transfer arm 12*a* is connected to the movable frame part 7. At one end of the transverse arm 12*a* a counter weight 17 is connected. An actuator 18 is connected to the movable frame part 7 and the transverse arm 12*a* for pivoting the transverse fluid transfer arm 12*a* around a third axis 26 extending in the length direction 3 of the structure 2. The movable frame part 7 is displaceable in the height direction along a height track 28. The fluid transfer arm 12*a* is connected to a length adjustment member comprising hinging pipes (50, 51 and 52) which comprise pivot joints (53, 54 and 55) to allow the displacement of the frame part (7).

An umbilical line 6 (is guided via the fluid transfer arms 12*a* and 20) such as a hydraulic line to activate the valves and the quick connection-disconnection unit 22 of the first structure 2.

The rigid fluid arm is connected to the transverse arm 12*a* via a movable joint 14 such as to be pivotable around a first axis 15 extending in the length direction 3 and a second axis 16 extending in the transverse direction 4. Both fluid transfer arms 12*a* and 20 can be reinforced by an additional rigid support structure (not shown) as for example is known from crane arms. The movable joint comprises a first fluid swivel 21*a* and a second fluid swivel 21*b* for allowing rotation respectively around the first axis 15 and second axis 16 while transferring fluids.

For positioning of the connecting member 22 it comprises a swivel 27(*a* and *b*) allowing rotation around an axis (not shown) extending respectively in the length direction and an axis extending in the height direction.

Figure 2:
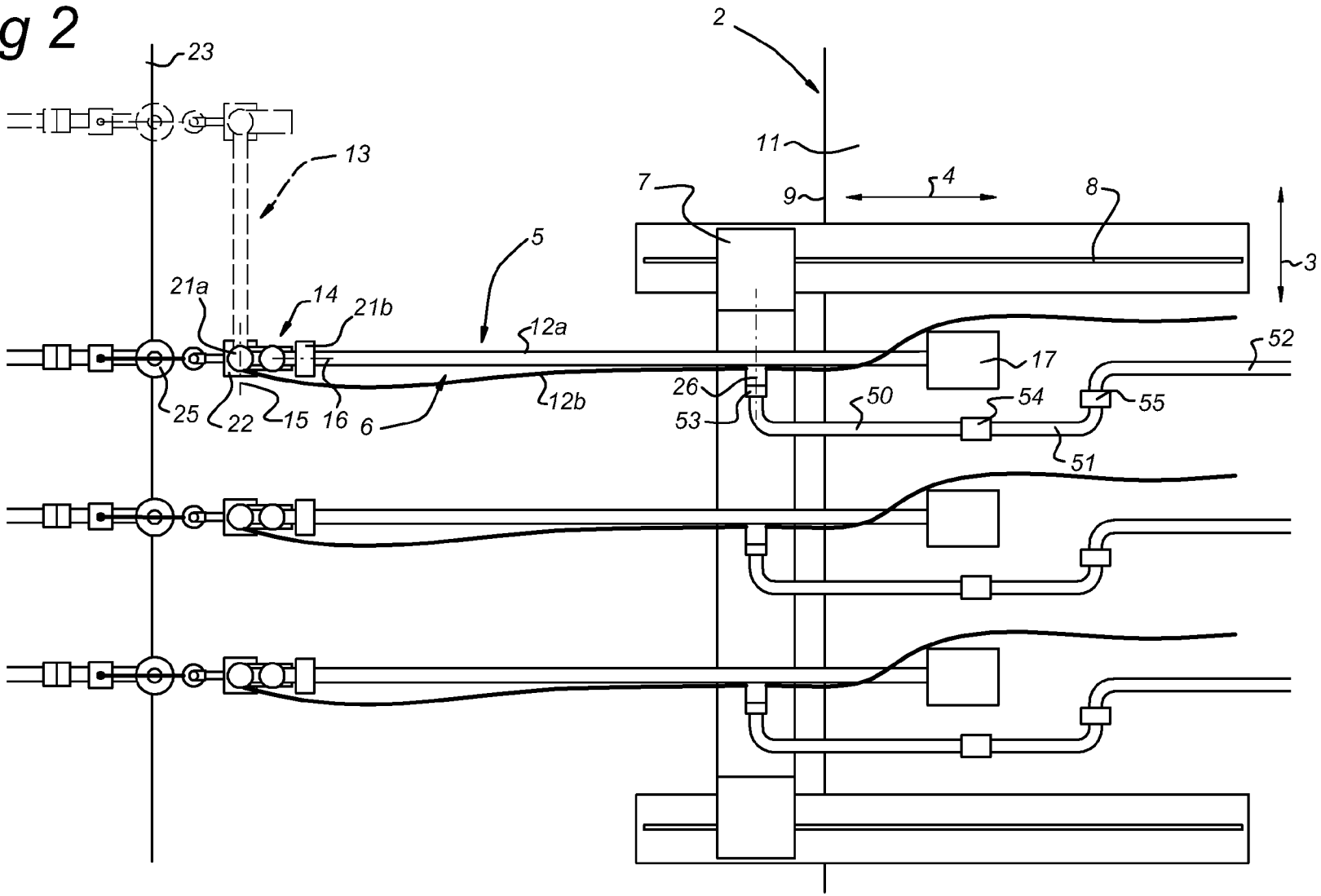

FIG. 2 shows a plan view of the hydrocarbon transfer system of FIG. 1. The parts of the hydrocarbon transfer system 1 shown with dotted lines have the position of the connection member 22 when the vertical duct part 20 is pivoted around the second axis 16 upon movement of the structure 23 in the length direction 3.

It will be clear to the person skilled in the art that many modifications of the embodiments of the present invention are possible without departing from the scope of protection as defined in the accompanying claims.

Figure 3:
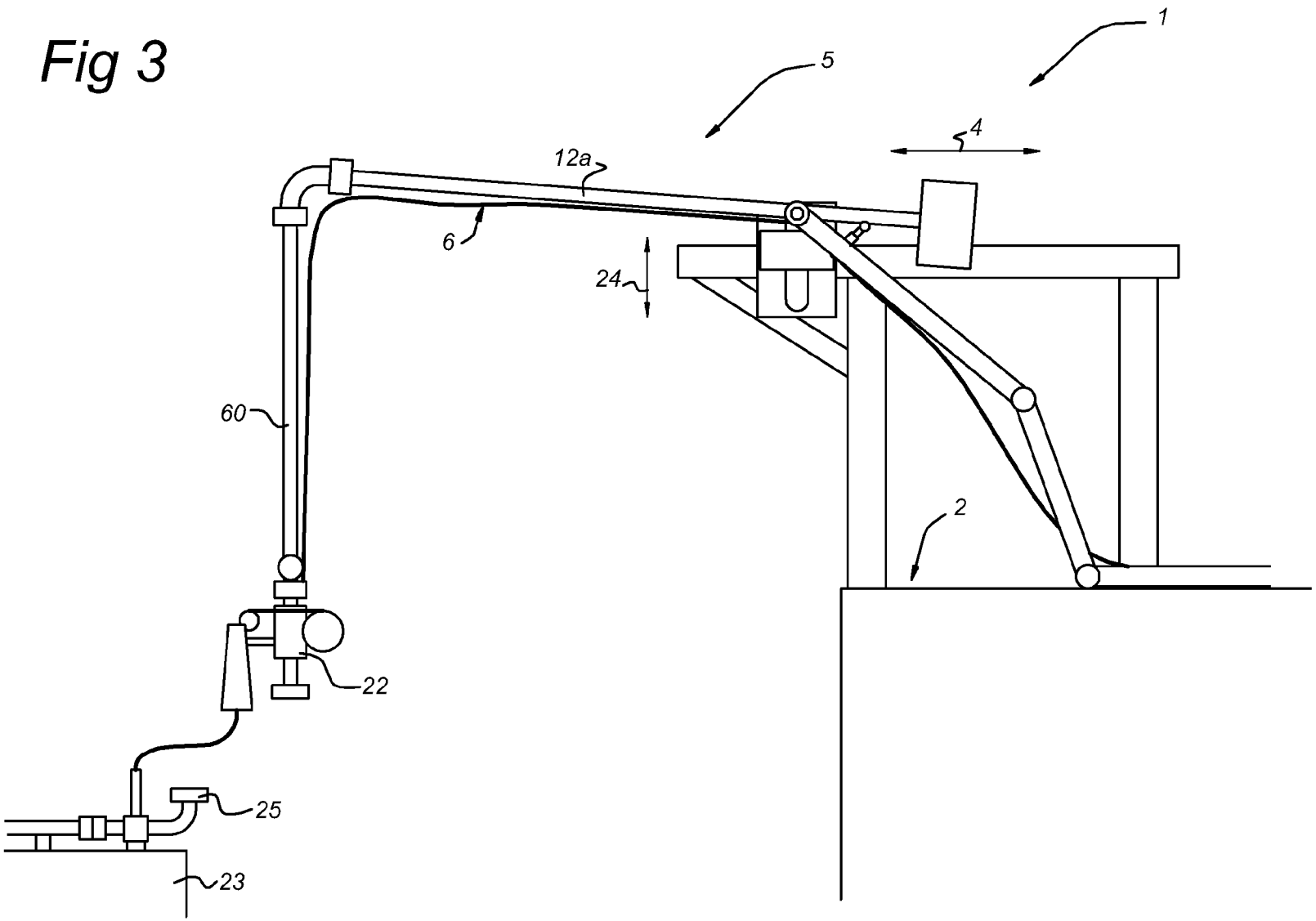

FIG. 3 shows a vertical flexible hose part 60 for the transfer of cryogenic fluid which is connected to the transverse arm 12*a*. The vertical flexible hose 60 part can be combined with a rigid support arm (not shown) extending downwardly and alongside the vertical hose from the transverse arm 12*a*.

The invention can also be practised with a completely flexible hydrocarbon transfer duct attached to a in the transverse direction movable frame without departing from the invention.

The invention claimed is:

1. A hydrocarbon transfer system, comprising:

a first structure having a length direction, a width direction and a deck level;

a support structure extending upwardly from the deck level of the first structure and supporting a track extending a transverse direction;

a movable frame part connected to the track; and a substantially transverse member and a vertical member attached to the movable frame part, the vertical member extending downwardly from a movable joint at a first end of the transverse member so that the vertical member is pivotable about a first axis extending in the length direction and a second axis extending in the transverse direction, wherein, the deck level is situated above a water level, the transverse member comprises a rigid fluid transfer duct, the vertical member comprises a secondary fluid transfer duct, and an end of the transfer duct of the transverse member at a second end of the transverse member is attached to an inboard fluid transfer duct on the first structure situated closer to the deck level than the transfer duct, via a length-adjustment fluid transfer member which is horizontally displaceable with a movement of the second end of the transverse member relative to the inboard fluid transfer duct.

2. The hydrocarbon transfer system according to claim 1, wherein the length-adjustment fluid transfer member comprises:

a first pipe having a first end attached to the transverse duct via a first swivel;

a second pipe, a first end of the second pipe attached to an end of the first pipe via a second swivel, and a second end of the second pipe attached to the inboard duct via a third swivel, the first, second and third swivels each being rotatable around axes that extend in the length direction.

3. The hydrocarbon transfer system according to claim 1, wherein the track projects beyond a perimeter of the first structure.

4. The hydrocarbon transfer system according to claim 2, wherein the fluid transfer duct is connected to a storage/processing or transfer element on the first structure via a coupling that configured to accommodate said movement of the second end of the transverse member relative to the inboard fluid transfer duct.

5. The hydrocarbon transfer system according to claim 1, wherein the first structure comprises a height direction and the movable frame part is displaceable in the height direction.

6. The hydrocarbon transfer system according to claim 1, the secondary transfer duct being connected to the joint such as to be pivotable about the first axis extending in the length direction and the a second axis extending in the transverse direction.

7. The hydrocarbon transfer system according to claim 6, wherein the transverse member is pivotably connected to the movable frame part, and a counterweight is connected at the second end of the transverse member.

8. The hydrocarbon transfer system according to claim 6, further comprising:

an actuator on the movable frame part configured to pivot the transverse member.

9. The hydrocarbon transfer system according to claim 6, wherein the vertical member comprises a flexible hose.

10. The hydrocarbon transfer system according to claim 6, wherein the secondary fluid transfer duct of the vertical member is connected to the transfer duct of the transverse member via a fluid transfer swivel allowing rotation about the first axis extending in the length direction and the second axis extending in the transverse direction.

11. The hydrocarbon transfer system according to claim 3, wherein the fluid transfer duct is connected to a storage/processing or transfer element on the first structure via a coupling configured to accommodate said movement of the second end of the transverse member relative to the inboard fluid transfer duct.

12. The hydrocarbon transfer system according to claim 2, wherein the first structure comprises a height direction, and the movable frame part is displaceable in the height direction.

13. The hydrocarbon transfer system according to claim 2, the secondary fluid transfer duct being connected to the joint such as to be pivotable about the first axis extending in the length direction and the second axis extending in the transverse direction.

14. The hydrocarbon transfer system according to claim 7, further comprising:

an actuator on the movable frame part configured to pivot the transverse member.

15. The hydrocarbon transfer system according to claim 7, wherein the secondary fluid transfer duct comprises a flexible hose.

16. The hydrocarbon transfer system according to claim 7, wherein the secondary rigid fluid transfer duct of the vertical member is connected to the transfer duct of the transverse member via a fluid transfer swivel allowing rotation about the first axis extending in the length direction and the second axis extending in the transverse direction.

17. The hydrocarbon transfer system according to claim 8, wherein the secondary fluid transfer duct comprises a flexible hose.

18. The hydrocarbon transfer system according to claim 8, wherein the secondary rigid fluid transfer duct of the vertical member is connected to the transfer duct of the transverse member via a fluid transfer swivel allowing rotation about the first axis extending in the length direction and the second axis extending in the transverse direction.

* * * * *